United States Patent [19]

Kulitzscher

[11] Patent Number: 5,018,554

[45] Date of Patent: May 28, 1991

[54] DEVICE FOR THE DAMPING OF PUMPS WITH INTERMITTENT DELIVERY

[75] Inventor: Berndt Kulitzscher, Steinmark, Fed. Rep. of Germany

[73] Assignee: Hoechst Aktiengesellschaft, Frankfurt am Main, Fed. Rep. of Germany

[21] Appl. No.: 394,533

[22] Filed: Aug. 16, 1989

[30] Foreign Application Priority Data

Aug. 18, 1988 [DE] Fed. Rep. of Germany ... 8810455[U]

[51] Int. Cl.[5] ..... F16L 55/04

[52] U.S. Cl. ..... 138/26; 138/30

[58] Field of Search ..... 138/26, 30; 137/593, 137/207; 417/540

[56] References Cited

U.S. PATENT DOCUMENTS 1,173,365 2/1916 McComb ..... 137/593
1,781,231 11/1930 Hillebrond ..... 138/26
2,376,178 5/1945 Ornstein ..... 137/593
2,646,039 7/1953 Agosti ..... 138/26
4,072,168 2/1978 Wittenmyer ..... 137/593
4,154,264 5/1979 Schaller ..... 138/26

FOREIGN PATENT DOCUMENTS 456011 6/1935 United Kingdom .

*Primary Examiner*—James E. Bryant, III
*Attorney, Agent, or Firm*—Finnegan, Henderson, Farabow, Garrett and Dunner

[57] ABSTRACT

In the device for the damping of pumps with intermittent delivery, a feed line (2) and a discharge line (3) for the medium to be delivered protrude into a slender tube (1), closed on both sides. The lines (2, 3) are led into the tube through one of the closed ends of the tube (1). In this arrangement, at least the outflow opening (8) for the discharge line (3) is arranged in the vicinity of the other closed end (9) of the tube.

7 Claims, 1 Drawing Sheet

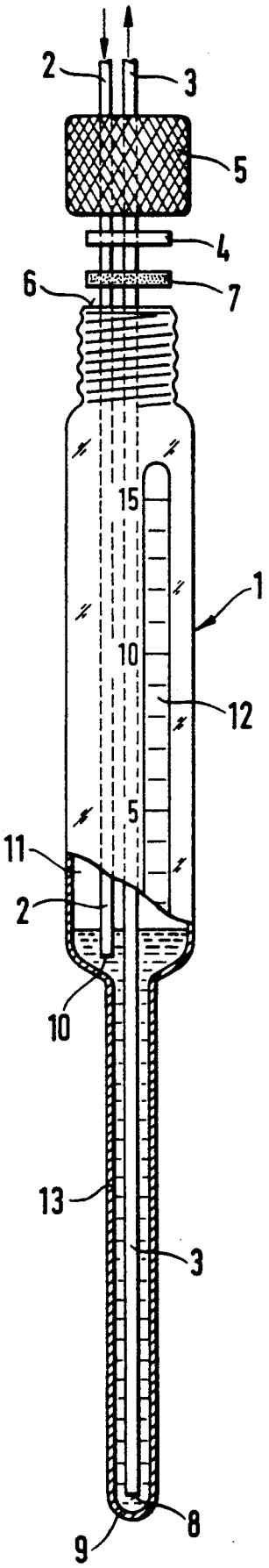
2
3
5
4
6
7
15
1
10
12
5
11
2
10
13
3
8
9

DEVICE FOR THE DAMPING OF PUMPS WITH INTERMITTENT DELIVERY

BACKGROUND OF THE INVENTION

1. Field of the Invention

The invention relates to a device for the damping of pumps with intermittent delivery.

2. Description of the Related Art

Pumps, such as reciprocating pumps, diaphragm pumps, hose pumps and the like have intermittent liquid delivery, which is problematic for many delivery tasks. To dampen the surges and thus make the volume flow uniform, devices are known in which the pressure surges of the pump are compensated for by a spring-loaded diaphragm. What is essentially disavantageous is the cleaning and maintenance of the moving parts which such devices have. In addition, such devices do not empty themselves automatically when the pump is switched off.

Consequently, the object exsists of creating a device of the stated type which is simple in its design, in particular has no moving parts and which empties itself substantially when the pump is switched off.

SUMMARY OF THE INVENTION

The object of the invention is achieved by a device wherein a feed line and a discharge line for the medium to be delivered protrude into a slender tube, closed on both sides, the lines being led into the tube through one of the closed ends of the tube, and at least the outflow opening for the discharged line being arranged in the vicinity of the other closed end of the tube.

The tube may be closed by a tube sheet at one end and by a closure at its other end, the lines being led through the closure. The tube may have a section which has a reduced cross section compared with the remaining tube.

The device, which can be produced inexpensively, is suitable inter alia for the operation of chromatography columns. It makes volume currents of up to 60 l/hour uniform. With its aid, it is possible to feed sample solutions and solvents to the column successively without back mixing by means of a pump.

BRIEF DESCRIPTION OF THE DRAWING

The device is explained in more detail below with reference to a drawing merely representing one embodiment. The figure shows the device partially in section and partially in exploded representation.

DESCRIPTION OF THE PREFERRED EMBODIMENT

Into a slender tube 1, closed on both sides, there protrudes a feed line 2 and a discharge line 3 for the medium to be delivered. In this case, the lines 2, 3 are led into the tube 1 through one of the closed ends. The lead-through may consist of a plate 4, which is pressed by means of cap screw 5 against the end 6 of the tube 1. If necessary, a seal 7 may be arranged between tube end 6 and plate 4. Of the lines 2, 3, of plastic, glass or metal, at least the outflow opening 8 of the discharge line 3 is arranged in the vicinity of the tube end, preferably closed by a sheet 9. If slvent and sample solution are to be charged sucessively, without one mixing with the other, the inflow opening 10 of the feed line 2 must not be arranged at the same level as the discharge opening 8 of the discharge line 3. Its level must be higher, to be precise high enough that the feed opening no longer dips into the liquid once the pump has been switched off, which must be the case during operation in order to avoid parts of the enclosed air volume 11 being entrained by the inflowing liquid, and thus being lost for the damping. In the region of the enclosed air volume 11, the tube 1 may, unless produced from a transparent material, have a window 12 with a pressure scale. In order to keep small the liquid remains in the device after switching off of the pump, the tube cross section between the inflow opening and outflow opening should be chosen smaller than the cross section of the remaining tube.

What is claimed is:

1. A device for the damping of a pump having intermittent liquid delivery, the device, comprising:

a tube defining an air chamber and having a first closed end and a second closed end, the first end having a cross-sectional area that is less than a second cross-sectional area at the second end of the tube;

means enclosed in said chamber for damping pressure surges;

a feed line extending into said tube through an opening in said second end, said feed line including an inflow opening disposed at a distal end thereof; and a discharge line extending into said tube through an opening in said second end, said discharge line having an outflow opening disposed proximate said first closed end of said tube, said outflow opening of said discharge line being spaced a distance from the inflow opening of the feed line so that the inflow opening no longer dips into the liquid once the pump has been switched off in order to avoid air volume in said tube from being entrained in liquid exiting through said discharge line.

2. The device as set forth in claim 1, wherein said first closed end of said tube includes a tube sheet and said second end of said tube includes a closure surrounding the opening, said feed line and said discharge line each extending through the opening in said closure.

3. The device as set forth in claim 1, wherein said tube includes a first portion, a second portion, and an intermediate portion, said first portion having a cross-sectional area less then a cross-sectional area of said second portion, and said intermediate portion extending between and connecting said first portion and said second portion.

4. The device as set forth in claim 3, wherein said outflow opening of said discharge line is disposed in said first portion of said tube.

5. The device of claim 3, wherein said inflow opening of said feed line is disposed in said tube proximate said intermediate portion.

6. A device for the damping of a pump having intermittent liquid delivery, the device comprising:

means enclosed in said chamber for damping pressure surges;

a tube defining an air chamber and having a first portion, a second portion and an intermediate portion connecting said first and second portions, said first portion having a cross-sectional area of lesser dimension than a cross-sectional area of said second portion, said first and second portions including closed distal ends;

a feed line extending into said tube through the closed end in said second portion, said feed line having an inflow opening disposed proximate said intermediate portion;

a discharge line extending into said tube through the closed end of the said second portion, said discharge line having an outflow opening disposed in said tube proximate said, outflow opening of said discharge line being spaced a distance from the inflow opening of the feed line so that the inflow opening no longer dips into the liquid once the pump has been switched off in order to avoid air volume in said tube from being entrained in liquid exiting through said discharge line.

7. A device for the dampening of a pump having intermittment delivery the device comprising:

a tube defining an air chamber and having a first closed end and a second closed end;

means enclosed in said chamber for damping pressure surges;

a feed line extending into said tube through the said second closed end, said feed line terminating in an inflow opening, said inflow opening being disposed in a region of said tube at approximately the midpoint between said first and second ends;

a discharge line extending into said tube through said second closed end, said discharge line having an outflow opening disposed proximate said first end, remote from said inflow opening, said outflow opening of said discharge line being spaced a distance from the inflow opening of the feed line so that the inflow opening no longer dips into the liquid once the pump has been switched off in order to avoid air volume in said tube from being entrained in liquid exiting through said discharge line.

* * * * *

UNITED STATES PATENT AND TRADEMARK OFFICE

CERTIFICATE OF CORRECTION

PATENT NO. : 5,018,554

DATED : May 28, 1991

INVENTOR(S) : Berndt Kulitzscher

It is certified that error appears in the above-identified patent and that said Letters Patent is hereby corrected as shown below:

Claim 1, column 2, line 16, delete "," (second occurrence); line 34, after "off" insert --and--.

Claim 6, column 2, lines 58-59, "means enclosed in said chamber for damping pressure surges." should be inserted at line 67.

Claim 6, column 2, line 68, change "in said" to --of the--.

Claim 6, column 3, line 4, delete "the".

Claim 6, column 3, line 6, delete "," and after "said (2nd occur.) insert --closed distal end of the first portion, said --.

Claim 6, column 3, line 10 after "off" insert --and--.

Claim 7, column 3, line 14, delete "intermittment" and insert --intermittent liquid--, and after "delivery" insert --,--.

UNITED STATES PATENT AND TRADEMARK OFFICE

CERTIFICATE OF CORRECTION

PATENT NO. : 5,018,554

DATED : May 28, 1991

INVENTOR(S) : Berndt Kulitzscher

It is certified that error appears in the above-identified patent and that said Letters Patent is hereby corrected as shown below:

Claim 7, column 4, line 15, after "off" insert --and--.

Signed and Sealed this

Twentieth Day of July, 1993

*Attest:*

Michael K. Kirk

MICHAEL K. KIRK

*Attesting Officer*

*Acting Commissioner of Patents and Trademarks*